US007791858B2

(12) United States Patent
Hummel et al.

(10) Patent No.: US 7,791,858 B2
(45) Date of Patent: Sep. 7, 2010

(54) DATA COMMUNICATION IN ELECTRONIC BLASTING SYSTEMS

(75) Inventors: Dirk Hummel, Hennef (DE); Michael John McCann, Chadds Ford, PA (US); Charles Michael Lownds, Aurora, CO (US); Erich Nicol Meyer, Schoemansville (ZA)

(73) Assignee: Orica Explosives Technology Pty, Ltd., Melbourne (AU)

( * ) Notice: Subject to any disclaimer, the term of this patent is extended or adjusted under 35 U.S.C. 154(b) by 43 days.

(21) Appl. No.: 11/792,952

(22) PCT Filed: Jan. 24, 2006

(86) PCT No.: PCT/AU2006/000087

§ 371 (c)(1),
(2), (4) Date: Oct. 19, 2007

(87) PCT Pub. No.: WO2006/076778

PCT Pub. Date: Jul. 27, 2006

(65) Prior Publication Data

US 2008/0041261 A1 Feb. 21, 2008

(51) Int. Cl.
*F42D 1/05* (2006.01)

(52) U.S. Cl. ..... 361/247; 361/248; 102/262

(58) Field of Classification Search ..... 102/215, 102/200; 361/248, 247, 251
See application file for complete search history.

(56) References Cited

U.S. PATENT DOCUMENTS 4,410,789 A * 10/1983 Story ..... 219/132
4,576,093 A 3/1986 Snyder
4,884,506 A 12/1989 Guerreri
5,159,149 A 10/1992 Marsden
5,235,329 A * 8/1993 Jackson ..... 340/902
6,546,873 B1 4/2003 Andrejkovics et al.
6,714,530 B1 * 3/2004 Haartsen et al. ..... 370/347
6,938,689 B2 9/2005 Farrant et al.
6,970,726 B2 * 11/2005 Takayanagi ..... 455/574
7,021,216 B1 * 4/2006 Dragne et al. ..... 102/200
2002/0006299 A1 1/2002 Anagnostopoulos et al.
2005/0030695 A1 2/2005 Meyer et al.
2005/0243499 A1 * 11/2005 Hallin et al. ..... 361/248
2006/0042495 A1 * 3/2006 Russell ..... 102/217
2006/0262480 A1 * 11/2006 Stewart ..... 361/251
2008/0302264 A1 * 12/2008 Hummel et al. ..... 102/215
2008/0307993 A1 * 12/2008 Chan et al. ..... 102/214

FOREIGN PATENT DOCUMENTS

WO WO-00/26607 A1 5/2000
WO WO-01/59401 A1 8/2001
WO WO-03/029748 A1 4/2003
WO WO-03/076868 A1 9/2003

* cited by examiner

*Primary Examiner*—Stephen W Jackson
*Assistant Examiner*—Angela Brooks
(74) *Attorney, Agent, or Firm*—Birch, Stewart, Kolasch & Birch, LLP.

(57) ABSTRACT

An electronic blasting system (10) comprising a plurality of hardware components (12.1 to 12.n), wherein at least two of components of the plurality of hardware components (20, 26) are adapted to communicate with each other over short range radio link (30)

13 Claims, 2 Drawing Sheets

DATA COMMUNICATION IN ELECTRONIC BLASTING SYSTEMS

BACKGROUND OF THE INVENTION

The present invention relates to electronic blasting systems and, in particular, to electronic blasting systems that rely on a short range wireless radio frequency link for data exchange between components of the system.

In general terms electronic blasting systems are well known in the art. A characteristic of such systems is the use of electronic delay detonators to achieve precise detonation, and preferably these detonators are fully programmable with respect to detonation delay time. The use of such detonators affords significant benefits in terms of blast control and design.

In addition to electronic delay detonators an electronic blasting system involves a variety of other hardware, such as logging and control equipment. In order to implement successfully a pre-determined blast design and to initiate a blast according to that design, it is important that the various components of the system communicate with each other as required. Conventionally, communication between components requires some form of physical (hard) connection between the relevant components and to this end various types of connecting means are used, for example wires, plugs, connectors, adaptors, etc. Such connecting means are an effective way of allowing components to communicate with each other but their use is not without practical problems.

Electronic blasting systems are used in a wide variety of applications, including surface and underground mines, quarries and civil engineering sites, and the environment under which the system is used can vary enormously. It is not uncommon, especially in mining applications, for the prevailing environment to make installation and operation of an electronic blasting system difficult. Thus, it is common to encounter wet or humid conditions and extremes of temperature. The available light may also be limited and there may be little room to move. Making the required physical connections between components under such conditions can be a serious challenge. This is an important issue however since the reliability of such connections can have serious consequences on the safety and productivity of a blasting operation. Here it should also be noted that blasting operations can involve very "abrasive" environments and connectors such as wires, plugs etc can easily be damaged. Thus, even if a good connection is initially established, it is possible that this may subsequently be impaired or destroyed. In the case that the blasting operation is taking place in a remote location, the need to rely on a variety of components to achieve connections between hardware components can be a further burden, and forgetting such componentry can be inconvenient and costly.

SUMMARY OF THE INVENTION

Against this background it would be desirable to provide an electronic blasting system that reduces or obviates these drawbacks.

Accordingly, the present invention provides an electronic blasting system comprising a plurality of hardware components including a blasting machine and at least one electronic detonator, wherein at least two components of the plurality of hardware components are adapted to communicate with each other over short range wireless radio link.

The present invention resides in the use of one or more short range wireless radio links to enable data communication between at least two hardware components that are necessary for implementation and/or operation of an electronic blasting system and that might otherwise have relied upon a hard connection to achieve the same data communication. The use of a short range wireless radio link in this way allows the kind of problems described above to be mitigated.

Herein the term "hardware component" is intended to denote a piece of equipment that is necessary for implementation and/or operation of an electronic blasting system. Thus, and as will be explained, the hardware component may perform a variety of different functions within the context of the blasting system. The function of the hardware component is in itself conventional, and the present invention resides in the way in which certain hardware components communicate with each other in order to achieve the required system functionality.

BRIEF DESCRIPTION OF THE DRAWINGS

Embodiments of the present invention are illustrated in the accompanying non-limiting Figures in which.

DETAILED DISCUSSION

Figure 1:
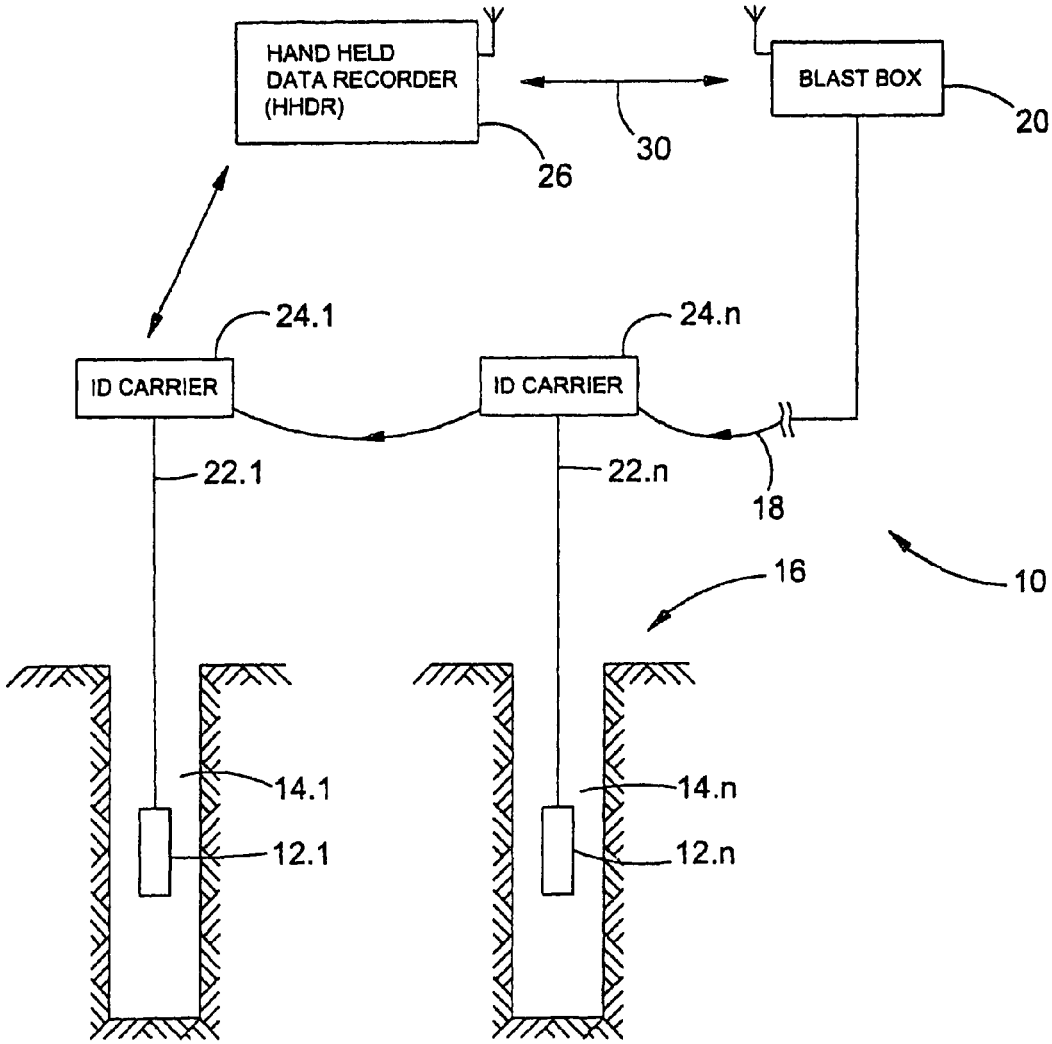
FIGS. 1 and 2 are schematic representations of an electronic blasting system in accordance with the present invention.

In accordance with the present invention it is a requirement that at least two components of the plurality of hardware components making up the blasting system are adapted to communicate with each other over a short range wireless radio link. It will be appreciated that this imposes certain restrictions on the nature of the at least two components that are in communication with each other in this way. Thus, there must be between the at least two components a working inter-relationship such that some form of communication between them is required during implementation and/or operation of the electronic blasting system. Furthermore, the fact that communication between the at least two components takes place over a short range wireless radio link requires that the at least two components be used in relatively close proximity to each other.

It may be preferred that the at least two hardware components are not consumed/destroyed when the blasting system of the present invention is employed a blasting process so that the at least two components may be used repeatedly in blasting operations. In this case, the at least two components are most likely to be control and/or implementation equipment rather than detonators.

Communication between the at least two components involves the transfer of any information necessary for implementation and/or operation of the electronic blasting system. This may involve the communication of simple or complex data and/or commands. The communication may be uni-directional in the sense that one component transmits information and another component receives that information, or bidirectional in the sense that the components exchange information.

Herein the term "blasting machine" embraces any type of (electronic) device that is used in an electronic blasting system and that is capable in being in signal communication with one or more electronic detonators being used. The blasting machine may be in direct communication with one or more of the electronic detonators or the blasting machine may communicate with one or more of the electronic detonators indirectly via one or more intermediate devices. The blasting machine may be in signal communication with one or more of the electronic detonators in order to send various command signals such as ARM, DISARM and FIRE signals and/or to program the detonators with detonation delay times and/or identification codes. Alternatively, or additionally, the blasting machine may be capable of receiving information from one or more of the electronic detonators. This information may include the identification code and/or detonation delay time assigned to individual detonators or the status of detonators, for example to confirm that the detonators are ready to be fired. The functionalities described for the blasting machine are not intended to be limiting and other functionalities will be apparent from the following description of the invention. It is to be appreciated from the preceding definitions that the blasting machine is a hardware component of the electronic blasting system in accordance with the present invention. Similarly, the electronic detonators making up the electronic blasting system of the invention are also hardware components. It is of course not essential that the blasting machine and one or more electronic detonators are in communication with each other over a short range wireless radio link, although this is clearly a possibility in accordance with the present invention. Usually though electronic detonators are not one of the at least two components that are adapted to communicate with each other over a short range wireless radio link.

In accordance with the present invention the at least two components, as described, are adapted to communicate with each other over a short range wireless radio link. In this context "short range" means that the maximum (uninterrupted) distance between the at least two components for effective communication to take place is about 10 meters. To provide this communication functionality each of the at least two components will include a communication module including a suitable short range radio communication transceiver. A variety of known communication standards/protocols may be used and one skilled in the art of wireless communication technology will be familiar with these. Preferably, the at least two components will include Bluetooth™ modules to make use of that short range communication protocol. Other short-range communication modules may be suitable for use in the present invention such as IEEE 802.15.4 (or Zigbee™) modules. To allow the communication modules to operate, each of the at least two components will also include some form of power supply. Depending upon context it may be important to use a low voltage or low power power supply. This would be particularly so where the communication module is associated with an electronic detonator, as might be the case. The use of a low voltage or low power power supply would minimise the risk of inadvertent detonator actuation arising from stray communications signals. In normal use a signal of sufficient power to initiate a detonator is generated only upon receipt of a command signal to initiate a detonator.

In its simplest form the blasting system of the present invention includes only two components that are adapted to communicate with each other over a short range wireless radio link. However, the invention is not restricted to this situation and the blasting system may include three or more components that are adapted to communicate with each other in this way. Herein components that are adapted to communicate amongst themselves are referred to as forming a wireless network. Likewise, the blasting system may comprise multiple wireless networks, each wireless network comprising at least two components that are adapted to communicate over a short range wireless radio link.

In the case that the electronic blasting system of the invention includes more than one wireless network, unintentional communication or interference between components in different wireless networks is not likely to take place since the range of wireless communication used in accordance with the present invention is relatively short (about 10 m or less). However, to the extent that hardware components of different wireless networks are in such close proximity to each other during use, communication/interference between wireless networks may be avoided by known methods. One skilled in the art of wireless communications would be familiar with how to approach this issue if necessary. For example, the Bluetooth™ communication protocol uses spread-spectrum frequency hopping to avoid undesired interference between transmitters.

In an embodiment of the invention components within the same wireless network are adapted to communicate with each other as required on an ad hoc basis when the components are brought into proximity (10 m or less) with each other. In this embodiment, once activated, the individual components find and recognise each other and are able to communicate without any user input being required to initiate this. This embodiment relies on the formation of a radio frequency (RF) wireless personal area network (WPAN) or piconet. An RF WPAN is a "spontaneous network" in that the connected components are only temporarily part of a communication network. In the case of mobile or portable components, they remain part of the network only while in relatively close proximity to the rest of the network.

The present invention also provides a method of communicating data in an electronic blasting system comprising a plurality of hardware components including a blasting machine and at least one electronic detonator, the at least two hardware components of the plurality of hardware components being adapted to communicate with each other over short range wireless radio link, which method comprises forming a wireless personal area network among at least two of the plurality of hardware components and communicating data via the wireless personal area network. It will be appreciated that this embodiment of the present invention relates to practical application of the electronic blasting system in accordance with the present invention. The electronic blasting system maybe used in a variety of blasting operations. Typically, these will be commercial mining and/or excavation operations.

Similar considerations as described above apply in relation to the hardware components making up the WPAN. The WPAN will be established using a short range wireless radio protocol as described herein. In a preferred embodiment the WPAN includes at least three hardware components in communication with each other.

To implement this aspect of the invention any of the IEEE standards (or protocols) in the 802.11 series, the Zigbee standards (IEEE 802.15.4), the IEEE 1451 standard for linking sensors to transceivers or the Bluetooth™ standard may be employed or provide basis for design. The TinyOS operating system and platform targeting wireless sensor networks may also be used or provide basis for design. For practical implementation, nanoNET from Nanotron Technologies GmbH,
Microstrain's "Agile Link",
Aerocomm's Flexible MeshRF,
Crossbow Technology's Smart Dust Motes,
Dust Network's SmartMesh,
Ember's EM2420 transceivers,
Firetide Instant mesh networks,
Kyon's Autonomic Networks,
Mesh Networks system
Millennial Net products NovaRoam mobile networks
OrderOne scalable networks or other physical implementations of such networks can, for example, be used.

By way of example, a Bluetooth™ device playing the role of "master" can communicate with numerous (up to 7) components playing the role of "slaves". At any given instant in time, data can be transferred between the master and one slave, but the master switches rapidly from slave to slave in a round-robin fashion. The Bluetooth™ specification also allows the connection of two or more WPANS together to form a scatternet, with some components acting as a bridge by simultaneously playing the master role in one WPAN and the slave role in another WPAN. This embodiment may find use in the context of the kind of electronic blasting system disclosed in the applicant's U.S. patent application No. 60/646,312 the content of which is incorporated herein by reference. This describes a blasting system in which certain components are in wireless communication with each other for direct communication between the components and/or to relay data/information over a blast field by the establishment of ad hoc or self-organising communication networks. The latter aspect may enable communication to be extended over a significant area without necessitating direct communication between components those components that are to communicate with each other.

Any component of the blasting system in the WPAN may perform an "inquiry" to find other components to which to connect, and any component can be configured to respond to such inquiries. Pairs of components may establish a trusted relationship by learning (by user input) a shared securities code or "passkey". A component that wants to communicate only with a trusted component can crytopgraphically authenticate the identity of the other component. For safety and security purposes trusted components may also encrypt the data that they exchange.

The Bluetooth™ protocol operates in the licence-free ISM band at 2.45 GHz (from about 2.40 to 2.48 GHz in practice). In order to avoid interfering with other protocols which use the 2.45 GHz band, the Bluetooth™ protocol divides the band into 79 channels (each 1 MHz wide) and changes channels up to 1600 times per second (spread-spectrum frequency hopping).

Figure 2:
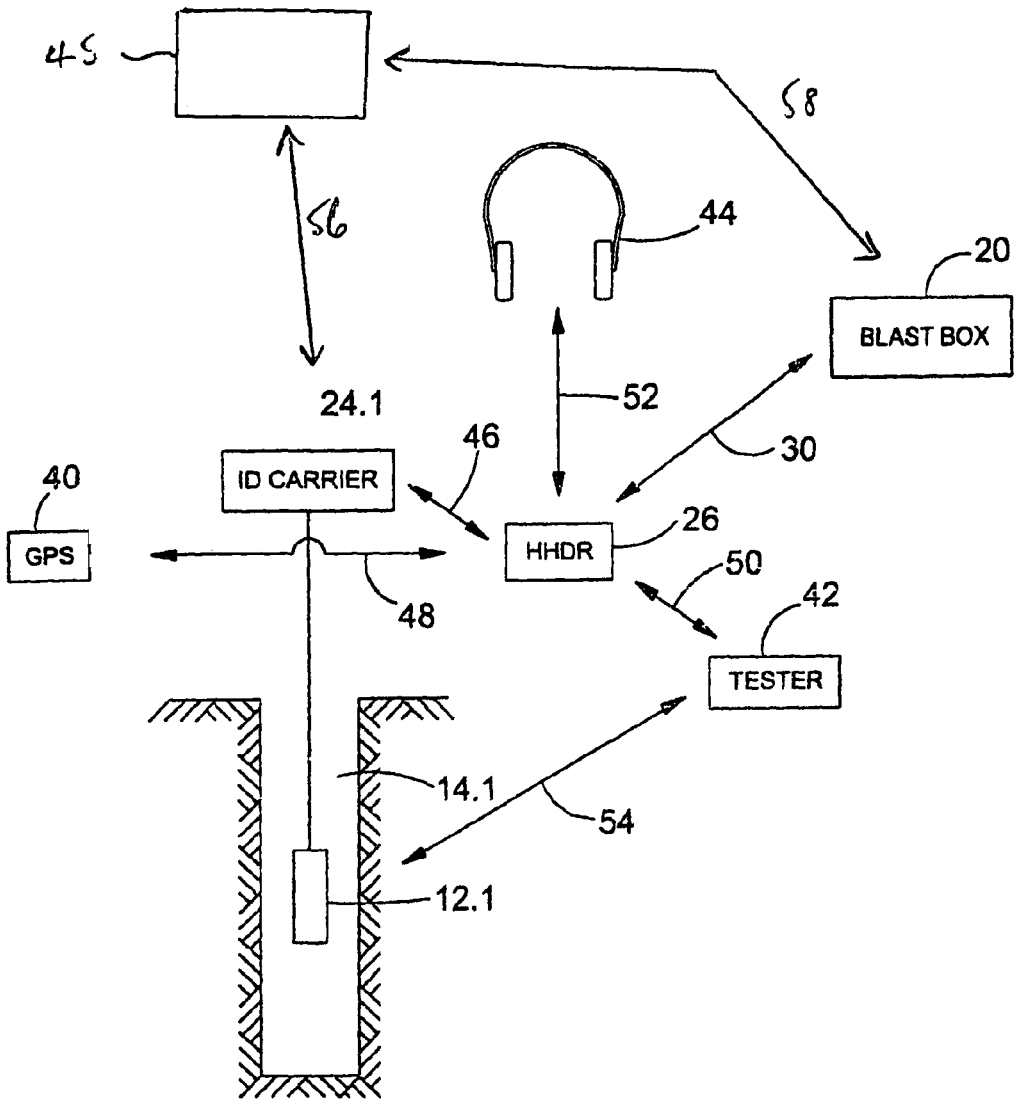

Components that may usefully communicate with each other over a WPAN will become apparent from the following figures, in particular FIG. 2.

The underlying philosophy of the present invention may be applied to a variety of components that would otherwise be used in a conventional electronic blasting system and that would communicate with each other over some form of physical link. In accordance with the present invention such components may be adapted and to communicate with each other over a short range wireless radio link thereby forming a wireless network. Examples of such components are given below with reference to FIGS. 1 and 2. These figures are schematics illustrating electronic blasting systems in accordance with the present invention, but should not be regarded as limiting with respect to the components and wireless networks that are depicted and described.

The present invention relies on short range wireless radio link for communication between hardware components. In practice implementation and/or operation of an electronic blasting system in accordance with the present invention will invariably involve other forms of communication to allow hardware components to communicate with each other as required. These other forms of communication may rely on physical connections between components and/or on wireless communications technology, such as infra-red or radio communications technology. In this context it is envisaged that in certain embodiments the blasting system of the present invention will include a hardware component that is adapted for short range wireless radio communication (with at least one other suitably adapted hardware component), and that is also adapted for communication by another means of communication, i.e. other than short range wireless radio link (with at least one other suitably adapted hardware component). In this embodiment a single piece of hardware component is able to communicate as required with at least one other component via short range wireless radio link and with at least one another component via some other communication means. The form of communication used will depend upon the functionality of the various hardware components, and the context in which they are used.

FIG. 1 shows an electronic blasting system (10) comprising a plurality of electronic delay detonators (12.1 to 12.n), each positioned in a respective blasthole (14.1 to 14.n) at a blast site (16). The detonators (12.1 to 12.n) are connected by respective downlines (22.1 to 22.n) to a harness wire (18), with the harness wire (18) being connected to a remote blast box (20). The blast box (20) may be used to program individual detonators (12.1 to 12.n) with detonation delay times based on identification numbers associated with each detonator. The blast box (20) may also be used to control functionality of the detonators (12.1 to 12.n) by transmission of pre-determined command signals, for example ARM, DISARM and FIRE. Each detonator (12.1 to 12.n) has associated with it an identity code carrier (24.1 to 24.n). This may take the form of a printed barcode applied to the detonator casing or associated label, or a radio frequency transponder. In other embodiments the identification code of a detonator may be located in a main housing of the detonator itself.

The electronic blasting system (10) also includes a hand held data recorder (26). In use a blaster would carrier the data recorder (26) from one blasthole (14.1 to 14.n) to a next with the identification data of respective detonators (12.1 to 12.n) being logged. The exact mechanism by which this takes place will obviously depend upon the form in which the identify data are presented or stored in relation to the detonators (12.1 to 12.n). The identity data, possibly with other data relating to the location of each of the detonators (12.1 to 12.n) (actual or by row/blasthole number), may also be stored in the data recorder (26). It is also possible at this time for the blaster to use to data recorder (26) to assign a delay time to each detonator (12.1 to 12.n). In this case the delay time that has been allocated is paired with detonator identification number and/or data pertaining to detonator location.

Data recorded at the blast site (16) by the data recorder (26) is thereafter downloaded into the blast box (20) for implementation of the blast. If the data recorder (26) has not been used to assign individual delay times to the detonators (12.1 to 12.n), this can be performed by the blast box (20) based on the identification code specific to each of the detonators (12.1 to 12.n).

In accordance with the present invention data communication over a short range wireless radio link may take place between the handheld data recorder (26) and the blast box (20). Alternatively, or additionally, and depending upon the way in which the identification is associated with a given detonator, it may also be possible for data communication over a short range wireless radio link to take place between the data recorder (26) and the identification code carrier (24.1 to 24.n) associated with individual detonators (12.1 to 12.n)

FIG. 2 shows essentially the same arrangement as FIG. 1 in that an electronic delay detonator (12.1) is provided in a blasthole (14.1) and has an associated identification code carrier (24.1). A data recorder (26) may be used as described in relation to FIG. 1 although in FIG. 2 various other hardware components that are capable of interaction/communication with the data recorder (26) are shown. Any one or more of these interactions may take place in accordance with the present invention, ie over a short range wireless radio link.

In order to determine the exact location of any given detonator, the electronic blasting system (10) may include a portable GPS transceiver (40). This may communicate with the data recorder (26) are required in order to report detonator location.

The data recorder (26) may communicate with a blast box (20) as described above in relation to FIG. 1. However, the data recorder (26) may also be in communication with a tester (42) in order to relay information as necessary. In turn, the tester (42) may communicate with individual detonators in order to undertake diagnostic system checks etc.

It is also possible that the data recorder (26) is in communication with a headset (44) worn by a blaster. This may be useful where the data recorder (26) is adapted to function under voice control, with the headset (44) relaying voice commands to the data recorder (26) as required. In this case the data recorder (26) will be equipped with voice recognition functionality and, possibly voice synthesis functionality, in order to provide vocal confirmation, guidance and/or warnings to the blaster.

It is also possible for the identification code carrier (24.1) to communicate with a portable/laptop computer (45) that is used for blast design. In turn, the computer (45) may be used to communicate information to the blast box (20) in order to implement and effect a blast design.

It will be appreciated from FIG. 2 that a variety of communication links, including those mentioned above and link 30, 46, 48, 50, 52, 54, 56 and 58, may be employed for implementation and/or operation of a blasting process. In accordance with the present invention one or more of these communication links may be achieved over a short range wireless radio link, with the intention of minimizing or avoiding altogether physical connections that would otherwise be required.

Other links necessary for implementation of the electronic blasting system may rely on other means of communication for exchange of data. For example, whereas the blast box (20) may communicate the data recorder (26) using a short range wireless radio link, for communication between the blast box (20) and the computer (45) a long range wireless radio link may be called for. In this case the blast box (20) is adapted to communicate with different hardware components using different communications methods/protocols. The combined use of short range wireless radio link and one or more other communications methods/protocols will invariably be required in an electronic blasting system since even the use of communications networks based on short range wireless radio links is unlikely to be practical or convenient over an entire blast site.

The invention claimed is:

1. An electronic blasting system comprising a plurality of hardware components including a blasting machine and at least two electronic detonators, wherein at least two components of the plurality of hardware components are adapted to communicate with each other over a short range wireless radio link in which the maximum distance between the at least two components for effective communication to take place is about 10 meters, wherein the at least two components are adapted to automatically communicate with each other over the short range wireless radio link as required when the components are brought into proximity with each other by formation of a wireless personal area network among the at least two components.

2. A blasting system according to claim 1, wherein the at least two hardware components are selected from hardware components that will not be consumed/destroyed when the electronic blasting system is employed in a blasting process.

3. A blasting system according to claim 1, wherein communication between the at least two hardware components is uni-directional.

4. A blasting system according to claim 1, wherein communication between the at least two hardware components is bi-directional.

5. A blasting system according to claim 1, wherein the at least two hardware components communicate with each other using Bluetooth™ short range communication protocol.

6. A blasting system according to claim 1, wherein the at least two hardware components communicate with each other using IEEE 802.15.4 short range communication protocol.

7. A blasting system according to claim 1, comprising only two components that are adapted to communicate with each other over the short range wireless radio link.

8. A blasting system according to claim 1, comprising three or more components that are adapted to communicate with each other over the short range wireless radio link.

9. A blasting system according to claim 1, wherein the at least two hardware components communicate with each other using IEEE 802.11, IEEE 802.15.4, IEEE 1451 (for linking sensors to transceivers) or Bluetooth™ short range communication protocol or using TinyOS operating system and platform targeting wireless sensor networks.

10. A blasting system according to claim 1, comprising multiple wireless networks, each wireless network comprising at least two hardware components that are adapted to communicate with each other over short range wireless radio link.

11. A blasting system according to claim 10, wherein hardware components within the same wireless network are adapted to communicate with each other over the short range wireless radio link as required on an ad hoc basis when the components are brought into proximity with each other.

12. A blasting system according to claim 11, wherein the at least two hardware components communicate with each other using IEEE 802.11, IEEE 802.15.4, IEEE 1451 (for linking sensors to transceivers) or Bluetooth™ short range communication protocol or using TinyOS operating system and platform targeting wireless sensor networks.

13. A method of communicating data in an electronic blasting system comprising a plurality of hardware components including a blasting machine and at least two electronic detonators, the at least two hardware components of the plurality of hardware components being adapted to automatically communicate with each other over a short range wireless radio link in which the maximum distance between the at least two components for effective communication to take place is about 10 meters when the components are brought into proximity with each other, which method comprises forming a wireless personal area network among at least two of the plurality of hardware components and communicating data via the wireless personal area network.

* * * * *